US008172966B2

(12) United States Patent
Blau et al.

(10) Patent No.: US 8,172,966 B2
(45) Date of Patent: May 8, 2012

(54) NON-LETHAL PAYLOADS

(75) Inventors: Reed J. Blau, Richmond, UT (US); Lisa S. Liu, Layton, UT (US); Ronald L. Hansen, Tremonton, UT (US); Richard G. Ames, King George, VA (US)

(73) Assignee: Alliant Techsystems Inc., Arlington, VA (US)

( * ) Notice: Subject to any disclaimer, the term of this patent is extended or adjusted under 35 U.S.C. 154(b) by 0 days.

(21) Appl. No.: 11/369,908

(22) Filed: Mar. 7, 2006

(65) Prior Publication Data

US 2011/0168305 A1 Jul. 14, 2011

(51) Int. Cl.

| | |
|---|---|
| ***C06B 45/00*** | (2006.01) |
| ***C06B 43/00*** | (2006.01) |
| ***C06B 33/00*** | (2006.01) |
| ***C06B 33/12*** | (2006.01) |
| ***D03D 23/00*** | (2006.01) |
| ***D03D 43/00*** | (2006.01) |

(52) U.S. Cl. ..... 149/108.2; 149/2; 149/22; 149/37; 149/40; 149/108.6; 149/109.2; 149/109.4

(58) Field of Classification Search ..... 149/108.2, 149/109.6, 2, 22, 37, 40, 108.6, 109.2, 109.4
See application file for complete search history.

(56) References Cited

U.S. PATENT DOCUMENTS

| | | | | |
|---|---|---|---|---|
| 3,309,249 | A * | 3/1967 | Allen | 149/19.3 |
| 3,479,954 | A * | 11/1969 | Bolieau | 102/336 |
| 3,601,053 | A * | 8/1971 | Grall et al. | 102/334 |
| 3,760,729 | A * | 9/1973 | Freeman | 102/346 |
| 3,895,578 | A * | 7/1975 | Shaw et al. | 102/336 |
| 6,086,693 | A | 7/2000 | Mendenhall et al. | |
| 6,253,680 | B1 | 7/2001 | Grubelich | |
| 2003/0034642 | A1 * | 2/2003 | Blakemore et al. | 280/741 |
| 2005/0115721 | A1 * | 6/2005 | Blau et al. | 169/5 |

OTHER PUBLICATIONS

Bender, Susan F.A., et al., "Less-than-lethal "Flashbang" Diversionary Device," Sand Report, SAND2003-4045, Sandia Nat'l. Lab., Albuquerque, NM 87185 & Livermore, CA 94550, 26 pages, printed Nov. 2003.

Military Specification entitled Pellets/Granules/Boron/Potassium Nitrate; MIL-P-46994B dated Jan. 4, 1982, (20 pages).

Lakshminarayanan, G.R., et al., "Evaluation of Alternative Fuel and Binder Materials in Hand Held Signals Illuminant Compositions," Technical Report ARWEC-TR-99008, U.S. Army Armament Research, Development and Engineering Center, Warheads, Energetics & Combat-Support Armament Center, Picatinny Arsenal, New Jersey, 45 pages, Nov. 2000.

* cited by examiner

*Primary Examiner* — James McDonough
(74) *Attorney, Agent, or Firm* — TraskBritt

(57) ABSTRACT

Non-lethal payloads may be customized for particular uses and desired visual and audible incapacitation based upon the selection of igniter/activators and illuminants used with the non-lethal payloads. Non-lethal payloads employing high flame temperature igniter/activators and illuminants of powder metals, powdered metals combined with oxidizers, and powdered metals combined with heat-activated chromophores may produce improved "flashes" and "bangs" for non-lethal payloads used with diversionary or other devices. Such devices and methods of producing illuminance and noise are also disclosed.

14 Claims, 9 Drawing Sheets

NON-LETHAL PAYLOADS

GOVERNMENT RIGHTS

The United States Government has certain rights in this invention pursuant to Contract No. N00178-01-D-1015, between the United States Department of the Navy, Naval Service Warfare Center, Dahlgren Division, and Alliant Techsystems Inc.

BACKGROUND OF THE INVENTION

1. Field of the Invention

The present invention generally relates to non-lethal payloads, devices incorporating the same and methods of producing illuminance and noise. More particularly, embodiments of the invention relate to non-lethal payloads and devices including such payloads for delivering improved flash, noise, and pressure variances to incapacitate, distract or incapacitate as well as distract one or more subjects. These effects may also be used as warning shots to attract the attention of individuals in vehicles or water vessels entering unauthorized areas or to maintain a standoff distance of riotous crowds.

2. State of the Art

Non-lethal devices and diversionary devices, such as so-called "flash-bangs," are used by a variety of military, law enforcement, security and other personnel to provide diversions in combat or operational situations or to provide demonstrations and simulated combat conditions during training. When activated, non-lethal devices or diversionary devices deliver a flash of light and noise to an area surrounding the activated device, the light and sound being designed to temporarily incapacitate personnel without causing permanent injuries. The flash of light may temporarily blind one or more persons viewing the flash of light and the noise produced by the device may incapacitate a person's auditory capabilities.

The desired effect of a non-lethal device or flash-bang device is to temporarily distract or incapacitate one or more people within a general vicinity of the device when the device is activated. Ideally, the device does not permanently injure or fatally wound people exposed to the effects of an activated device. With these goals in mind, non-lethal devices have been developed to deliver the desired intensity, or flashes, of light and corresponding noise. However, in some instances, activation of the non-lethal devices occasionally results in unwanted fatalities.

For example, the United States Government has used a diversionary device based on the design of an M116A1 hand-grenade simulator, which has a cardboard body. Typically, an M201 fuse was attached to the M116A1 hand-grenade simulator using a potting compound. The diversionary devices based upon the M116A1 hand-grenade simulator, while effective, also exhibited some problems with flash-throughs in the fuse assembly. At times, the flash-throughs would cause premature activation of the device, which could result in injuries or fatalities for the user of the device. In addition, the M201 fuses used with the diversionary devices were occasionally ejected from the device upon activation at velocities that could be potentially lethal or injurious to users and to subjects in the blast zone of the device when activated. In addition, occasional fires have been caused by the burning of the cardboard body of the M116A1 hand-grenade simulator after activation of the device. At times, excessive smoke could also be produced by the device, which smoke could interfere with the desired activities of the personnel employing the diversionary device.

In an attempt to resolve some of the problems of diversionary devices based on the M116A1 hand-grenade simulator, a new diversionary device was created: the Mk141. The Mk141 includes a fire-retardant foam body and a smaller charge of flake aluminum and potassium perchlorate flash powder housed in the body. A molded plastic fuse assembly connected to the body helps to eliminate flash-through problems. In addition, a small pyrotechnic charge separates the fuse from the main body of the device such that, upon activation, a high-speed ejection of the fuse from the device caused by the flash-powder may be prevented. The use of the foam body for the Mk141 helps to reduce the production of high-density fragments that could cause injury upon fragmentation, also helps to reduce the instance of fires, and produces less smoke than other devices.

The Mk141 does have some problems, however. For example, if the Mk141 is activated too close to a subject, the near field effects such as the pressure and noise may be extreme enough to injure or fatally wound the subject. In addition, the charges used with the Mk141 include Class 1.1 explosives, which are sensitive to shock, thermal, electrostatic, and mechanical ignition stimuli. Thus, the Mk141 must be handled with extreme caution because of the explosives used.

Other undesired characteristics of the Mk141 and M116A1 hand-grenade simulator type diversionary devices also cause concern. For example, such devices rely upon an energetic material to cause their explosive output, which energetic material may be accidentally activated. If the energetic material is activated while the device is in contact with a person, such as a user carrying the device, the activation of the device may blow off a person's hand or limb, or may cause a fatal wound.

In an attempt to prevent injuries caused by diversionary devices such as the Mk141 device and the M116A1 hand-grenade simulator device, alternative diversionary devices are being developed. An example of an improved diversionary device is disclosed in U.S. Pat. No. 6,253,680 to Grubelich, assigned to Sandia Corporation, and entitled "Diversionary Device." The Grubelich patent discloses a device in which a black powder propellant is used to heat an aluminum powder fuel and move it from the device, wherein the heated aluminum powder mixes with ambient air and is activated for producing a fuel/air explosion.

Although improvements in diversionary devices have been made, there remains a desire to further improve the incapacitating characteristics of such devices. For example, improvements in the ability of a device to produce a flash that impairs the visual capabilities of a subject exposed to the device for a longer period of time are desired. Improvements in the noise produced by such devices is also desired, for example, such that the "bang" caused by the device shocks a subject without causing permanent auditory damage or fatal injury to the subject. There is also a continuing need to improve the safety of such non-lethal and diversionary devices.

SUMMARY OF THE INVENTION

According to embodiments of the invention, non-lethal payloads and devices including such payloads are provided for producing non-lethal flashes of light and non-lethal pressure variances, which may produce an audible sound. Some non-lethal payloads according to embodiments of the invention include improvements over conventionally available diversionary devices.

In some embodiments of the invention, the non-lethal payloads may include a high flame temperature igniter/activator that may be used to more efficiently heat and disperse a finely divided illuminant contributing toward more efficient combustion of the illuminant in a fuel/air explosion resulting in a brighter flash. The higher flame temperature igniter/activators of embodiments of the invention may provide improved burn rates and burn efficiencies for a given illuminant with air because they are able to heat the illuminant more efficiently before it comes in contact with air. For example, fuel/oxidizer combinations used high temperature igniters such as a granular mix of boron and potassium nitrate, a granular mixture of magnesium and strontium nitrate, and mixtures of the boron/potassium nitrate and magnesium/strontium nitrate may provide improved preheating of illuminants thus activating them more efficiently for reaction with air when compared to conventional lower flame temperature igniter/activators, such as black powder. Furthermore, the combustion of the igniter/activator may contribute significantly to the total visible light of the flash by producing red, green, violet, and white contributions to the visible flash for strontium, boron, potassium and magnesium, respectively.

In other embodiments of the invention, the selection of an illuminant to be used with a non-lethal payload may result in improved light output of the non-lethal payload. Powdered metals, and especially powdered magnesium, may be used with non-lethal payloads according to embodiments of the invention to improve the light output of a diversionary device employing the non-lethal payload. Other illuminants that may be used with embodiments of the invention include powdered aluminum, flaked aluminum, powdered titanium and powdered zirconium, to name a few.

In still other embodiments of the invention, the amount and duration of light produced by a non-lethal payload may be tailored by the addition of oxidizers to the illuminant being used with the non-lethal payload. Oxidizers such as sodium nitrate and strontium nitrate may be added to or mixed with an illuminant. The oxidizer may promote a more rapid combustion of the illuminant, decreasing the rise time and increasing the maximum light intensity of the flash. The total light output of the resulting flash varies, having a maximum at relatively low levels of oxidizer added to the illuminant.

According to other embodiments of the invention, an illuminant or igniter/activator of a non-lethal payload may also include heat-activated chromophores. The presence of heat-activated chromophores in the non-lethal payload may improve the light intensity or light output of the non-lethal payload upon activation.

Devices including the non-lethal payloads according to the invention and methods for producing light as well as noise using such payloads are also encompassed by the present invention.

BRIEF DESCRIPTION OF THE DRAWINGS

While the specification concludes with claims particularly pointing out and distinctly claiming that which is regarded as the present invention, this invention can be more readily understood and appreciated by one of ordinary skill in the art from the following description of the invention when read in conjunction with the accompanying drawings in which:

DETAILED DESCRIPTION OF THE INVENTION

Figure 1:
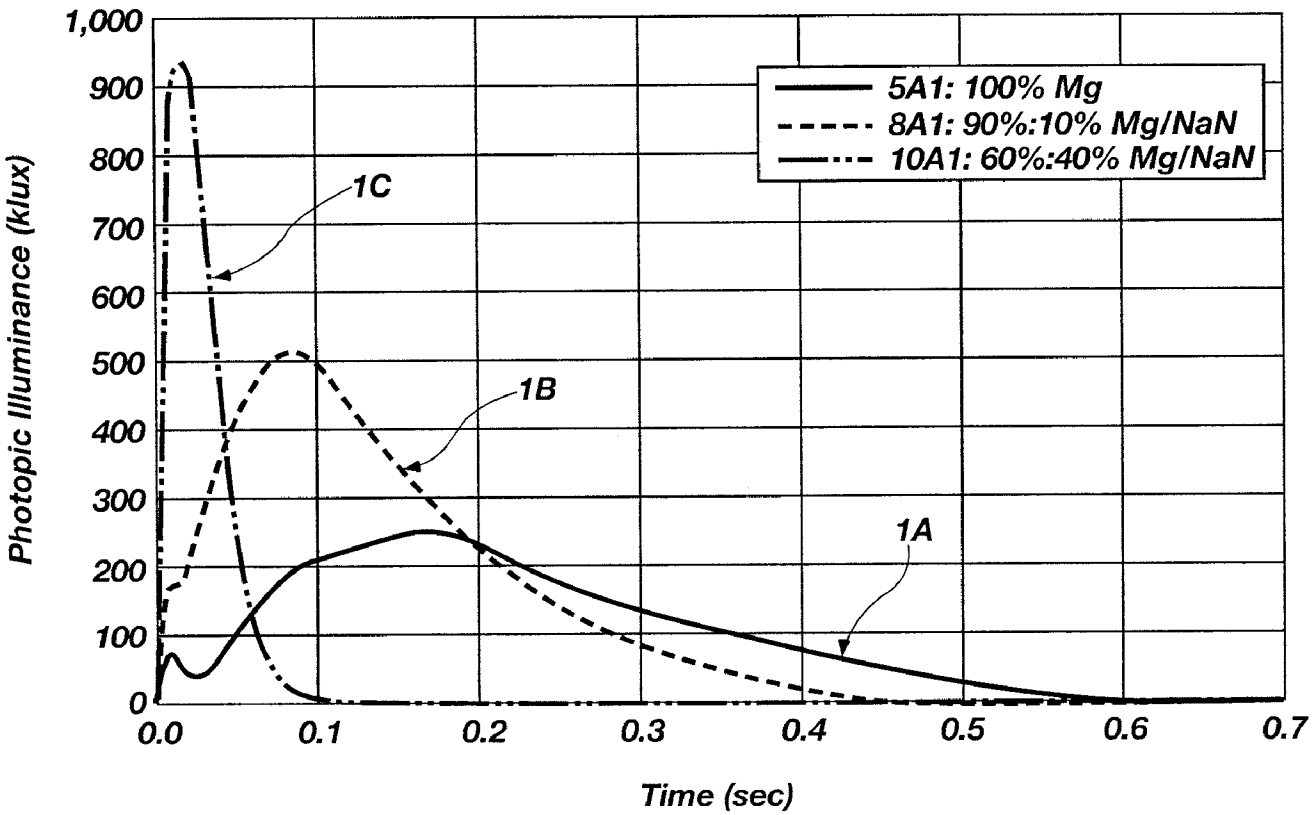
FIG. 1 illustrates a graph of photopic illuminance (klux) versus time for three illuminants according to embodiments of the invention.

According to some embodiments of the invention, a non-lethal payload that may be used with a device, such as a diversionary device, may include a non-lethal payload capable of providing an increased light impulse or impulses as compared to light impulses created by the activation of conventional diversionary devices.

The activation of a conventional diversionary device creates both an audible and a visual distraction. The visual distraction typically consists of a flash of light caused by an explosion or by the ignition of a fuel dispersed by the diversionary device. The fuel in a conventional diversionary device may be ignited by a propellant, such as black powder, or by a pyrotechnic charge, such as by Class 1.1 explosives. Embodiments of the present invention may also utilize a propellant or igniter/activator to ignite an illuminant or fuel dispersed from the non-lethal payload. However, the igniter/activators of particular embodiments of the invention improve the light output of the fuel or illuminant ignition by producing higher flame temperatures than conventional igniter/activators.

The igniter/activators of the non-lethal payloads according to embodiments of the invention produce higher flame temperatures than the igniter/activators of conventional diversionary devices. The higher flame temperatures produced by igniter/activators of embodiments of the invention produce greater illuminance for a diversionary device. The increased illuminance provides an improved visual distraction that is capable of temporarily visually impairing a subject viewing the illuminance caused by the activation of the non-lethal payload.

For example, an igniter/activator that may be used with non-lethal payloads according to embodiments of the invention may comprise boron potassium nitrate ($B/KNO_3$). When using the terms "boron potassium nitrate" herein, it is understood that the term includes $B/KNO_3$ and other variances of B/KN. Boron potassium nitrate may exhibit a flame temperature of about 3000 K, which is significantly higher than the flame temperature of black powder, which is about 2000 K. The higher flame temperature of the boron potassium nitrate enhances the intensity and the duration of a flash caused by the heating of the uncombusted fuel portion of the illuminant dispersed from the non-lethal payload, activating it for reaction with air. The enhanced intensity and duration of the visible distraction provided by the use of a high flame temperature igniter/activator is desirable. An example of boron potassium nitrate that may be used with embodiments of the invention includes UIX156, produced by ATK Thiokol, Inc. Other formulations containing boron as the fuel and potassium nitrate as an oxidizer will work equally well whether they contain a binder or are binder-free.

In other embodiments of the invention, the igniter/activator may comprise magnesium strontium nitrate ($Mg/Sr(NO_3)_2$). When using the term "magnesium strontium nitrate" herein, it is understood that the term includes $Mg/Sr(NO_3)_2$ and other variances of Mg/SrN. Magnesium strontium nitrate may exhibit a flame temperature of about 4000 K, which is higher than that of the boron potassium nitrate and black powder. The higher flame temperature provided by the magnesium strontium nitrate may improve the light intensity and duration of light produced by a non-lethal payload incorporating magnesium strontium nitrate into the igniter/activator of the non-lethal payload. An example of magnesium strontium nitrate that may be used with embodiments of the invention includes UIX189, produced by ATK Thiokol, Inc.

In still other embodiments of the invention, an igniter/activator for a non-lethal payload may comprise a mixture of boron potassium nitrate and magnesium strontium nitrate. The mixture may include about 5 percent to about 95 percent by weight of boron potassium nitrate and about 5 percent to about 95 percent by weight of magnesium strontium nitrate. The mixture of igniter/activators provides a high flame temperature igniter/activator that may improve the light intensity and/or duration of light produced by a non-lethal payload according to embodiments of the invention.

Boron potassium nitrate and magnesium strontium nitrate may also provide improved illuminance to the ignition of a non-lethal payload due to the presence of heat-activated chromophores in the igniter/activators of the present invention. Boron potassium nitrate includes boron, which provides a heat-activated chromophore in the visible light spectrum, and specifically in the visible green spectrum. The strontium in magnesium strontium nitrate provides a heat-activated chromophore in the visible red spectrum. The presence of the heat-activated chromophores in the visible spectrum may increase the intensity of illuminance produced by the ignition of a fuel or illuminant of a non-lethal payload by an igniter/activator according to embodiments of the invention.

In some embodiments of the invention, the igniter/activators may also be mixed with other substances, such as with a binder. Binders may be used to facilitate the handling of the igniter/activators or to facilitate the production of non-lethal payloads incorporating the igniter/activators of particular embodiments of the invention into a delivery device for the non-lethal payload. Binders conventionally used with explosive devices and diversionary devices, such as nylon, may also be used with non-lethal payloads according to embodiments of the invention.

In other embodiments of the invention, igniter/activators containing fuels comprising high surface metalloids including boron and silicon, reactive metals including magnesium, aluminum, titanium and zirconium, reactive metal alloys including any magnesium/aluminum alloy, and reactive metal hydrides, borides, nitrides or carbides such as $ZrH_2$ $TiH_2$, $TiB_2$, TiN and ZrC or combinations of these metalloids, reactive metals, reactive metal alloys, hydrides, borides, nitrides or carbides will produce a high temperature igniter/activator when combined with an oxidizer including alkali metal nitrates and perchlorates, alkaline earth metal nitrates and perchlorates and related oxidizers as well as combinations thereof. Optionally, a binder and/or a gas producing organic fuel may be added.

Although particular high flame temperature igniter/activators have been described with respect to embodiments of the invention, it is understood that other high flame temperature igniter/activators may be incorporated with embodiments of the invention. It is also understood that the high flame temperature igniter/activators of embodiments of the invention may be mixed with or used simultaneously with other lower flame temperature igniter/activators, such as black powder, to provide some improvements to non-lethal payloads incorporating high flame temperature igniter/activators. Non-lethal payloads according to other embodiments of the invention may also include an illuminant, or fuel, capable of improving the illuminance of a diversionary device employing the non-lethal payload. The illuminant may also be an inert material, which may be safely handled and transported without significant worry of accidental combustion.

According to some embodiments of the invention, an illuminant of a non-lethal payload may include finely divided powders, such as metal powders. For example, metal powders used as illuminants with embodiments of the invention may include magnesium powders, aluminum powders, titanium powders, zirconium powders, or other reactive transition metal powders. Other finely divided powders that may be used with embodiments of the invention may include those of reactive metal hydrides, borides, nitrides, or carbides, such as $ZrH_2$, $TiH_2$, $TiB_2$, TiN, and ZrC. The powder may include powders having one or more of spherical shapes, cylindrical shapes, flakes, or other shapes.

Magnesium (Mg) powders may be used as an illuminant for a non-lethal payload according to embodiments of the invention. For example, spherical magnesium powder, such as 65μ magnesium powders, may be used as an illuminant for a non-lethal payload. Other sizes, shapes, and diameters of magnesium powders may also be used.

Aluminum (Al) powders may also be used as an illuminant for a non-lethal payload of embodiments of the invention. For example, spherical aluminum metal powders, such as 5μ spherical aluminum metal powders, may be used as an illuminant with non-lethal payloads of embodiments of the invention. Spherical aluminum powders having different sizes and shapes may also be used. Other aluminum powders, such as high surface area, flaked, coated aluminum (also known as dark pyro aluminum) may also be used with embodiments of the invention.

Although aluminum metal powders have been used with other diversionary devices, the use of aluminum metal powders as an illuminant with embodiments of the invention may provide improvements over conventional diversionary devices. For example, black powder may be an effective igniter/activator for dark pyro aluminum but it is not as effective when employed with spherical aluminum metal powders. Instead, the combination of a spherical aluminum powder illuminant with a high flame temperature igniter/activator in a non-lethal payload may improve the ignition of the spherical aluminum powder upon activation of the non-lethal payload. Since spherical aluminum metal powders typically are not as efficiently heated as the high surface area black pyro aluminum, the combination of a high flame temperature igniter/activator with the spherical aluminum powder improves the ignition of the spherical aluminum powder and improves the combustion of the activated illuminant with air over a conventional device employing black powder as an igniter/activator. The improved ignition and combustion may result in improved light production of the non-lethal payload.

Other reactive transition metal powders, such as titanium or zirconium, may also be used with embodiments of the invention. These metal powders may exhibit a smaller illuminance than other metal powders, which may be beneficial in certain situations. Although the illuminance may be smaller, the use of titanium metal powders as an illuminant for a non-lethal payload may improve the sustainability of the illuminance for a longer period of time than other metal powders. Thus, the illuminance produced by a non-lethal payload according to embodiments of the invention may be tailored based upon the selection of metal powder used as an illuminant with the non-lethal payload.

According to other embodiments of the invention, an illuminant of a non-lethal payload may comprise a finely divided powder mixed with one or more additives. The addition of one or more additives may stabilize the illuminant, may enhance the combustion rate of the illuminant, or it may improve the illuminance produced upon ignition of the illuminant, such as by increasing the visible light output of the combusting illuminant.

For example, oxidizers may be blended with an illuminant to produce an improved illuminant for use with non-lethal payloads. The addition of an oxidizer may affect the rise time of the illuminance of the non-lethal payload, by decreasing the rise time, or amount of time from the activation of the non-lethal payload to achievement of a maximum illuminance, of the non-lethal payload. The addition of an oxidizer may also affect the amount of illuminance produced by the non-lethal payload. In other instances, a heat-activated chromophore capable of producing light in the visible spectrum may be mixed with an illuminant of a non-lethal payload to improve the illuminance of an ignited illuminant.

Oxidizers that may be incorporated with illuminants according to embodiments of the invention may include inorganic oxidizers. For example, oxidizers such as sodium nitrate, strontium nitrate, or other inorganic oxidizers may be used. An oxidizer may also be selected to include a heat-activated chromophore. If added to an illuminant, an oxidizer may be added in an amount between about 1 percent and about 40 percent by weight of the illuminant, although other amounts may also be used with embodiments of the invention.

Chemicals having heat-activated chromophores which may be incorporated with illuminants according to embodiments of the invention may include boron, strontium, and sodium. Boron (B) may produce heat-activated chromophores in the visible green spectrum and may be incorporated into an illuminant as boron nitrate or other boron containing substance. Strontium (Sr), which may be provided by the inclusion of strontium nitrate in the illuminant, may produce a heat-activated chromophore in the red visible spectrum. Sodium (Na) may produce a heat-activated chromophore in the yellow visible spectrum and may be added to an illuminant as sodium nitrate or other sodium containing substance. It is understood that other heat-activated chromophore producing substances may also be added to illuminants or igniter/activators of non-lethal payloads to improve or alter the characteristics of the illuminance of an activated non-lethal payload.

An example of improved illuminance achieved by mixing additives with a metal powder according to embodiments of the invention is illustrated in FIG. 1. Three illuminants according to embodiments of the invention were ignited to determine the illuminance produced by the illuminants: the first illuminant (1A) comprised 100 percent by weight magnesium powder; the second illuminant (1B) comprised 90 percent by weight magnesium powder and 10 percent by weight sodium nitrate; and the third illuminant (1C) comprised 60 percent by weight magnesium powder and 40 percent by weight sodium nitrate. As illustrated, the first illuminant (1A) provided a peak photopic illuminance of about 250 klux, the second illuminant (1B) provided a peak photopic illuminance of about 510 klux, and the third illuminant (1C) provided a peak photopic illuminance of about 930 klux. This data indicates that the addition of an oxidizer such as sodium nitrate to a metal powder to form an illuminant may improve the peak photopic illuminance achieved when the illuminant is activated or combusted.

The data illustrated in FIG. 1 also indicate that the addition of an oxidizer to metal powder to form an illuminant may be used to tailor the rise time, or time from activation to peak photopic illuminance, by decreasing the rise time of the illuminant. The data of FIG. 1 indicate that the third illuminant (1C), which included about 40 percent by weight of the sodium nitrate oxidizer, reached peak photopic illuminance quicker than the other two illuminants. The addition of 10 percent by weight oxidizer to the second illuminant (1B) also decreased the rise time of that illuminant over the illuminant comprising only the magnesium metal powder. Thus, if a decreased rise time for a non-lethal payload is desired, oxidizers, such as inorganic oxidizers, may be added to the illuminant of the non-lethal payload.

The data in FIG. 1 also indicate that the duration of the photopic illuminance is decreased with the increased addition of oxidizer to the illuminant. Therefore, if a high photopic illuminance is desired with a rapid rise time, more oxidizer may be added to the illuminant of a non-lethal payload. If a longer duration of photopic illuminance is desired for a non-lethal payload, an illuminant having little or no oxidizer added thereto may be preferred.

According to some embodiments of the invention, the illuminants of the non-lethal payloads may include a binder to improve the handling qualities of the illuminant. In some instances the binder may include an energetic binder.

In some embodiments of the invention, a non-lethal payload may include an igniter/activator to illuminant ratio of about 1 to about 5. In other embodiments a ratio of igniter/activator to illuminant of about 1 to about 20 may be utilized. In still other embodiments, a ratio of igniter/activator to illuminant may be about 5 to about 1.

According to still other embodiments of the invention, non-lethal payloads may be improved by tailoring the shape of the non-lethal payload, a device casing holding the non-lethal payload, or the delivery device used to deliver and activate a non-lethal payload. The illuminant and igniter/activator components of a non-lethal payload according to embodiments of the invention may be layered, mixed, shaped in a radial design, or otherwise tailored in relation to each other to provide a desired fireball from the non-lethal payload. For example, in a layered configuration, the igniter/activator may be layered over the illuminant in a delivery device. Activation of the igniter/activator may disperse the illuminant and ignite the illuminant to achieve activation of the non-lethal payload. In other designs, the igniter/activator may be positioned with respect to the illuminant to ensure that the illuminant is dispersed and ignited by the igniter/activator.

Figure 2:
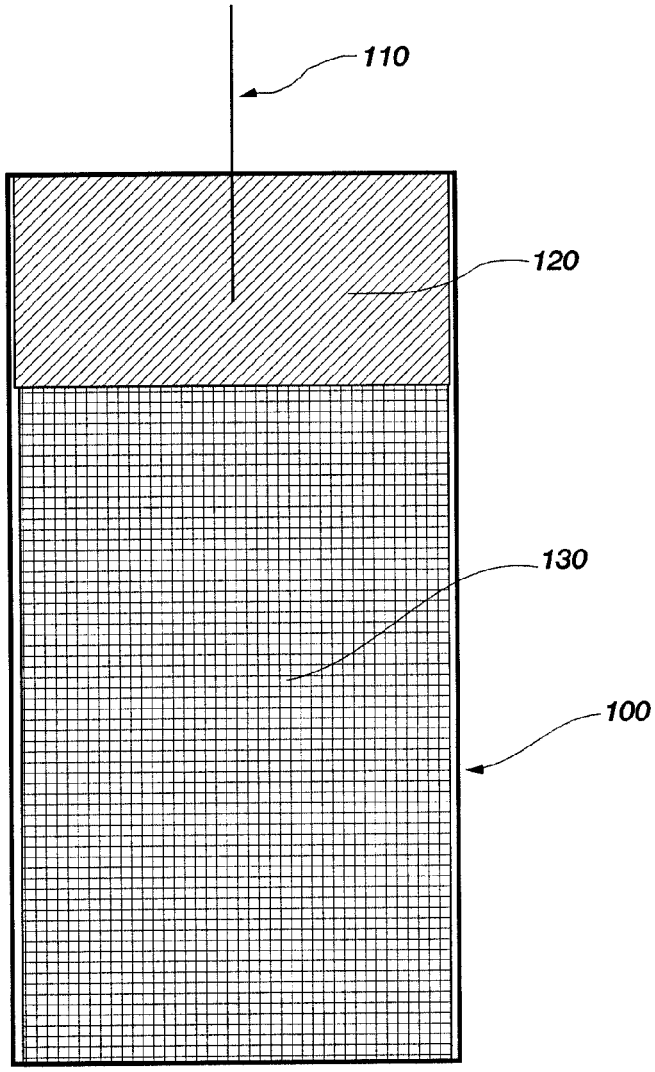
FIG. 2 illustrates a device for delivering a non-lethal payload having a layered configuration according to embodiments of the invention.

An example of a layered non-lethal payload according to embodiments of the invention is illustrated in FIG. 2. In FIG. 2, a cross-sectional view of a device casing 100 holding a non-lethal payload is illustrated. The non-lethal payload may be positioned in the device casing 100 such that the igniter/activator 120 overlies an illuminant 130. The device casing 100 may have a cylindrical shape as illustrated and may be constructed of a material such as cardboard, cardstock, or a foam-based material that will not produce lethal shrapnel upon activation of the non-lethal payload. In other embodiments, the device casing 100 may be constructed of a rigid material that will not fracture upon activation and distribution of the non-lethal payload, such as metal, with openings in the casing material (not shown) to release portions of the non-lethal payload upon activation. An initiation device 110, such as a fuse, may be placed through a portion of the device casing 100 where it may contact the igniter/activator 120 of the non-lethal payload.

Figure 3:
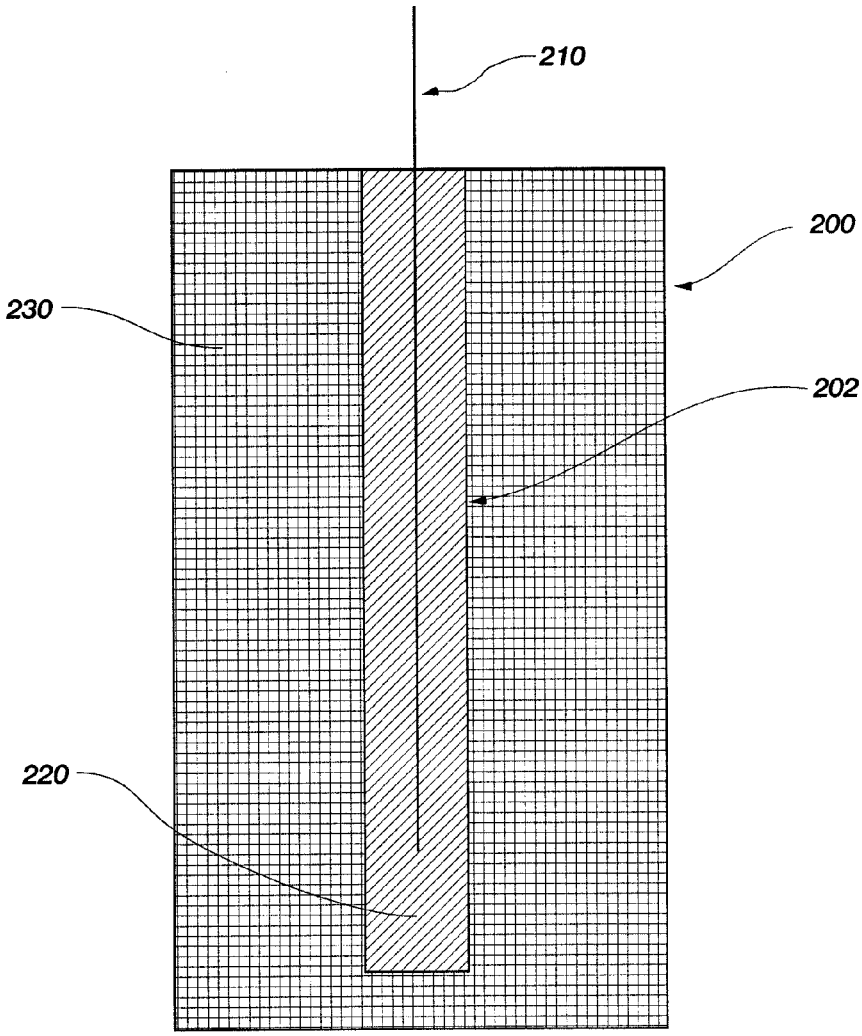
FIG. 3 illustrates a device for delivering a non-lethal payload having a radial configuration according to embodiments of the invention.

According to other embodiments of the invention, a non-lethal payload may be positioned in a device casing 200 such that the illuminant 230 of the non-lethal payload surrounds the igniter/activator 220 or a casing 202 holding the igniter/activator 220. An example of a non-lethal payload positioned in such a manner is illustrated in FIG. 3. The igniter/activator 220 may be positioned in an interior casing 202 of the device casing 200 and an illuminator 230 may be placed in an annulus surrounding an outer wall of the interior casing 202 and an inner wall of the device casing 200. The size, or diameter, of the interior casing 202 may be varied such that the amount of igniter/activator 220 to illuminant 230 may be customized for the desired non-lethal payload. An initiation device 210 may pass through the device casing 200 and into the interior portion of the interior casing 202 where the igniter/activator 220 is positioned. The initiation device 210 may also be placed near either end of the interior casing 202. Activation of the igniter/activator 220 by the initiation device 210 may result in the combustion products from igniter/activator 220 blowing the illuminator 230 out of the device casing 200 in a radial direction from the interior casing 202 and igniting the illuminator 230 to produce a fireball. As with the layered device, the device casing 200 and the interior casing 202 may be made from materials that will not produce lethal shrapnel upon activation of the non-lethal payload.

In other embodiments, a modified M116A1 hand-grenade simulator may be used to contain a non-lethal payload prior to activation. Similar to the configuration illustrated in FIG. 3, a modified M116A1 hand-grenade simulator may include an additional outer casing such as that illustrated in FIG. 4.

In other embodiments, the non-lethal payload may be positioned within a device to direct activation of the device in a specified direction. For example, a device casing may be configured with permanent and non-permanent components such that upon activation of a non-lethal payload in the device casing, the illuminant of the non-lethal payload is expelled through the non-permanent components and ignited. The direction of activation of the non-lethal payload may be controlled using device casing designed in such a fashion.

Figure 5:
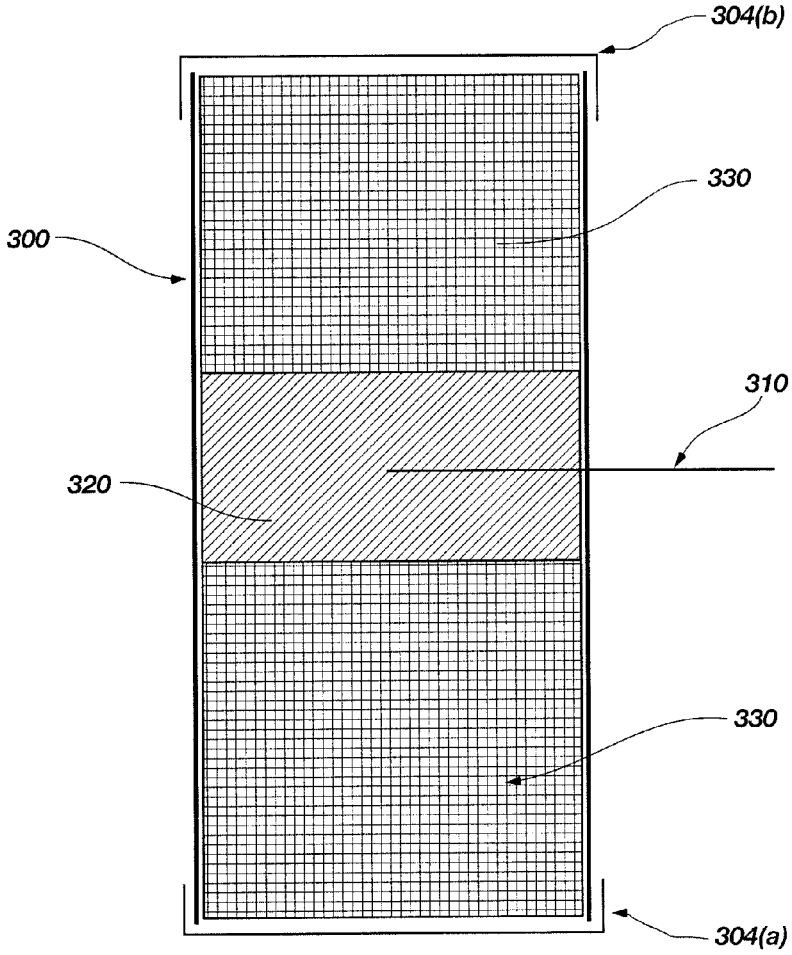
FIG. 5 illustrates a device for delivering a non-lethal payload according to embodiments of the invention.

For example, in accordance with some embodiments of the invention, a non-lethal payload may be contained within a device casing having one or more sealable openings at either end of a cylindrical, square, rectangular, or otherwise shaped tube. An example of such a device is illustrated in FIG. 5. A device casing 300 may be made of a material that will not fragment or otherwise decompose upon activation of the non-lethal payload contained within the device casing 300. Openings 304(*a*) and 304(*b*) in device casing 300 may be sealed with a material, which will allow the illuminant 330 within the device casing 300 to escape from the device casing 300 when the igniter/activator 320 is activated by the initiation device 310. Thus, if an operator is holding the device by the device casing 300 and the non-lethal payload is accidentally activated, the operator may not suffer permanent injury or a fatal wound from the device casing 300 disintegrating in the operator's hand. Although the operator may be exposed to the effects of activation of the non-lethal payload, a permanent injury may be avoided, which is a concern with conventional devices.

Although certain configurations for devices for holding non-lethal payloads according to embodiments of the invention have been described herein, it is understood that other configurations may also be used and that the embodiments of the invention are not limited to the described configurations.

Certain considerations may also be taken into account when designing or selecting a device casing to house non-lethal payloads according to embodiments of the invention. For example, if magnesium or a higher surface area aluminum is selected as an illuminant for a non-lethal payload, it may be beneficial to design the device casing to be impermeable to water vapor since hydrogen off-gassing could occur in humid environments. Device casing impermeability should also be considered if inorganic oxidizers are mixed with the illuminant since they absorb moisture, which may promote oxidation of the metal powders.

Non-lethal payloads of embodiments of the invention may also be tailored to provide reduced near-field pressures as compared to conventionally available diversionary devices. Near-field pressures include the pressures generated by diversionary devices when activated, and may be measured at a distance of eighteen inches from the point of activation. Near-field pressures contribute to the "bang" associated with diversionary devices. However, large near-field pressures are undesirable because they can cause permanent injury to the user of a diversionary device or to a subject exposed to the diversionary device.

The non-lethal payloads according to embodiments of the invention, when activated, provide smaller near-field pressures than do conventional devices. The non-lethal payloads of embodiments of the invention may also be tailored such that the near-field pressures can be controlled. For example, near-field pressures can be increased by decreasing the illuminant to activator ratio, increasing the oxidizer content in the illuminant and by increasing the confinement of the total payload. Thus, these devices offer a lower near-filed pressure primarily when the total payload is fuel rich. Fuel rich payloads acquire much of the oxygen required to produce a bright flash from the atmosphere and tend to produce lower near-field pressures.

A diversionary device according to embodiments of the invention may include a device casing, an initiation device, and a non-lethal payload. The non-lethal payload may be encased within the device casing and may comprise an illuminant and an igniter/activator according to embodiments of the invention. The initiation device, such as a fuse or primer may be in communication with the non-lethal payload such that activation of the initiation device triggers the activation of the non-lethal payload.

Device casings according to embodiments of the invention may include any type of device casing that may be used to contain and deliver a non-lethal payload. The shape, size, construction, and materials of the device casing need not be limited. For example, device casings according to embodiments of the invention may include grenade shells, missile components, warheads, bullets, artillery rounds, or other devices. In some embodiments, the device casings may include non-shrapnel producing materials or minimal-shrapnel producing materials, such as cardstock, paperboard, foams, plastics, or other materials that will produce little or no shrapnel upon the activation of a non-lethal payload contained within the device casing. For instance, modified M116A1 hand-grenade simulator casings such as the casing illustrated in FIG. 4 may be employed as a device casing with embodiments of the invention.

Initiation devices that may be used with diversionary devices according to embodiments of the invention may include any type of device that may be used to actuate or initiate the activation of a non-lethal payload according to embodiments of the invention, including initiation devices conventionally used to activate diversionary devices. For instance, initiation devices may include fuses, safety fuses, electric fuses, point-detonation fuses, electric matches, primers, remotely controlled fuses or detonators, or other devices, which may activate or ignite an igniter/activator of embodiments of the invention.

Activation of a non-lethal payload according to embodiments of the invention ignites the igniter/activator. Ignition of the igniter/activator disperses the illuminant into a cloud of illuminant and air. The igniter/activator also heats the illuminant, activating it toward reaction with the air, resulting in the production of a fireball that produces light and noise, the noise being caused by the pressure due to the reactions within the sealed device causing rupture of the device and release of the overpressure. Further variations in pressure result from reactions occurring after device rupture including reaction of the fuel components of the illuminant with air. The pressure wave may cause the subject to be severely jolted. The light from the fireball may incapacitate the visual acuity of a subject in the vicinity of the fireball and the noise produced by the non-lethal payload may incapacitate the auditory capacity of a subject.

Non-lethal payloads according to embodiments of the invention may be incorporated in a number of different devices and used for many different applications. Although many of the examples herein are described with reference to hand-held and hand-delivered devices, non-lethal payloads according to embodiments of the invention may also be incorporated with or delivered using weapon-fired devices, shoulder-fired devices, vehicle-fired devices, mortar-launched devices, air-dropped devices, air-launched devices, ship-fired devices, ship-launched devices, or remotely-activated devices or systems. Any delivery system conventionally used to deliver lethal or non-lethal ordnance may be configured or modified to deliver and activate non-lethal payloads according to embodiments of the invention.

EXAMPLES

A number of tests were performed to determine the feasibility of use of certain igniter/activators and illuminants according to embodiments of the invention. In the tests performed, the igniter/activators and illuminants were either packed in a layered configuration as described with respect to FIG. 2 or in a radially packed configuration as described with respect to FIG. 3. The layered configurations were tested by layering the igniter/activator and illuminant in a 20-gauge shotgun shell hull with a center-holed cork replacing the primer. An electric match was inserted through the center-holed cork as a fuse end of the shell. Igniter/activator was placed in the shell followed by a layering of illuminant. A paper wad was placed in the shell to maintain the layering and the shell was crimped. The radial configurations were tested using modified M116A1 hand-grenade simulator bodies to hold the igniter/activator and illuminant. Results of some of the testing are explained further with reference to the following examples.

Example 1

Figure 6:
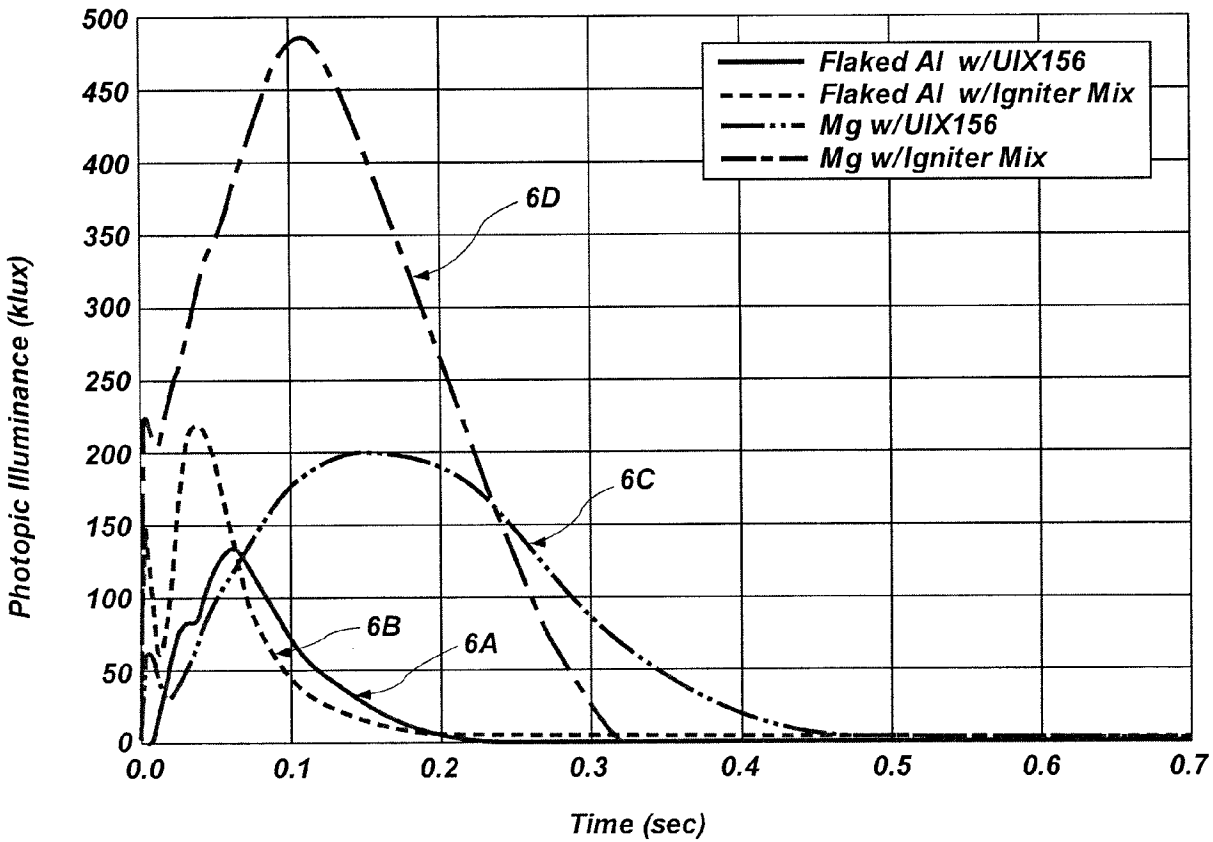
FIG. 6 illustrates a graph displaying photopic illuminance data for different igniter/activators and illuminants according to embodiments of the invention.

Igniter/activators were tested to determine the characteristics of a non-lethal payload using different igniter/activators. The results of four such tests are illustrated in FIG. 6. As illustrated, two tests were performed using flaked aluminum as an illuminant and two tests were performed using powdered magnesium as an illuminant. Two igniter/activators were used for the tests: UIX 156, which is a boron potassium nitrate, and an igniter mixture comprising about 50 percent by weight boron potassium nitrate to about 50 percent by weight magnesium strontium nitrate. The flame temperature of the igniter mixture was greater than the flame temperature of the UIX156 because the igniter mixture included magnesium strontium nitrate, which has a higher flame temperature than the boron potassium nitrate. The tests are labeled as follows: 6A is the flaked aluminum illuminant with UIX156; 6B is the flaked aluminum illuminant with the igniter mixture; 6C is the magnesium with UIX156; and 6D is the magnesium with the igniter mixture.

As illustrated in FIG. 6, the igniter mixture, when used as an igniter/activator, provided a larger amount of total light output from illuminant than did the boron potassium nitrate. In addition, the data indicate that the magnesium illuminant produces a greater amount of light output than does the aluminum for each respective igniter/activator. Thus, an igniter/activator having a higher flame temperature may produce a larger amount of total light output for a given illuminant.

Example 2

Figure 7:
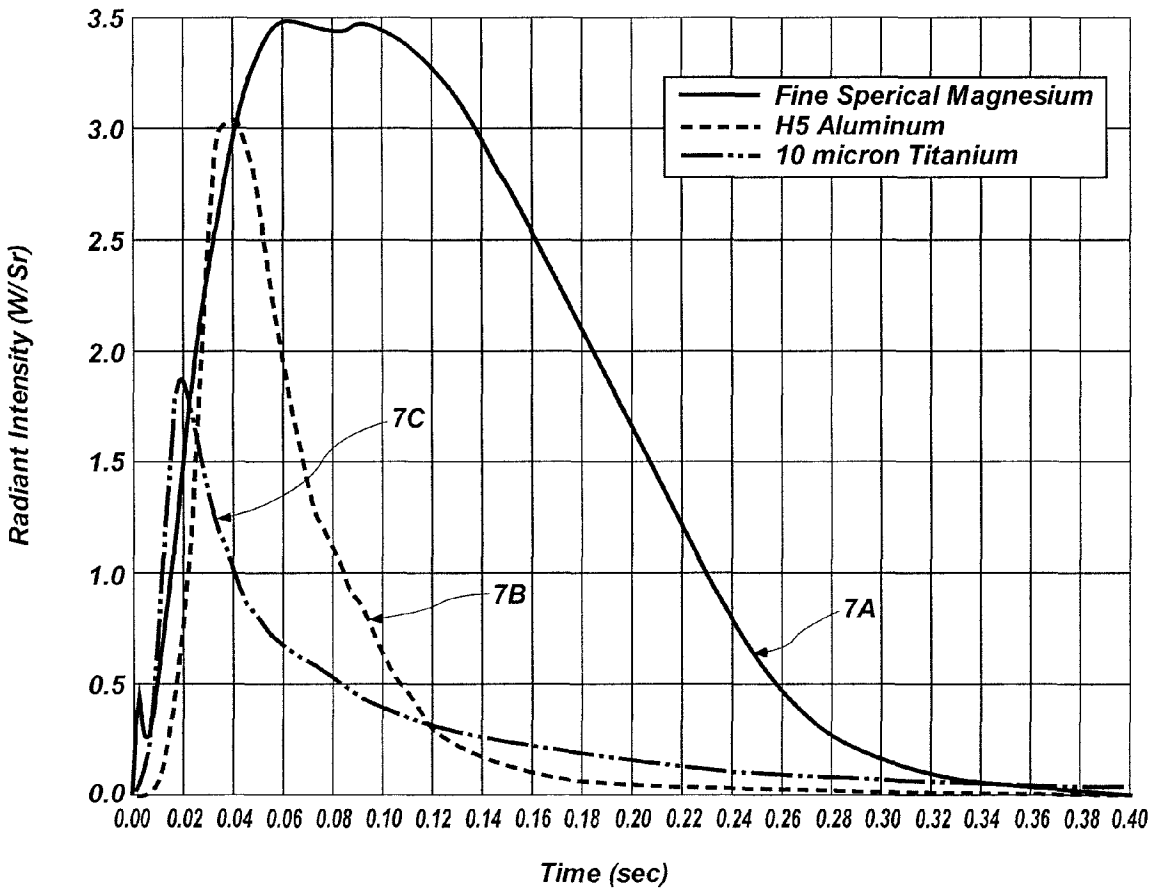
FIG. 7 illustrates a graph displaying radiant intensity versus time for various illuminants according to embodiments of the invention.

Three illuminants—spherical magnesium, H5 aluminum, and 10-micron titanium—were tested for use with a non-lethal payload in separate layered configurations to determine the radiant intensity of the illuminants over a period of time following activation of the non-lethal payload device. The igniter/activator used for each test was boron potassium nitrate. The results of the testing are illustrated in the graph of FIG. 7. As evident from the graph, the fine spherical magnesium illuminant (7A) produced the largest radiant intensity over time and also the longest period of sustained radiant intensity. The H5 aluminum (7B) produced a radiant intensity that was almost as large as that of the magnesium, but the intensity declined as fast as it inclined. The 10-micron titanium (7C) produced a smaller radiant intensity than either the spherical magnesium or the H5 aluminum.

Example 3

Tests were also performed to determine whether the ratio of igniter/activator to illuminant produced any effects in the visible output of non-lethal payloads comprised of the different ratios. The results of the tests performed are illustrated in FIG. 8.

Figure 8:
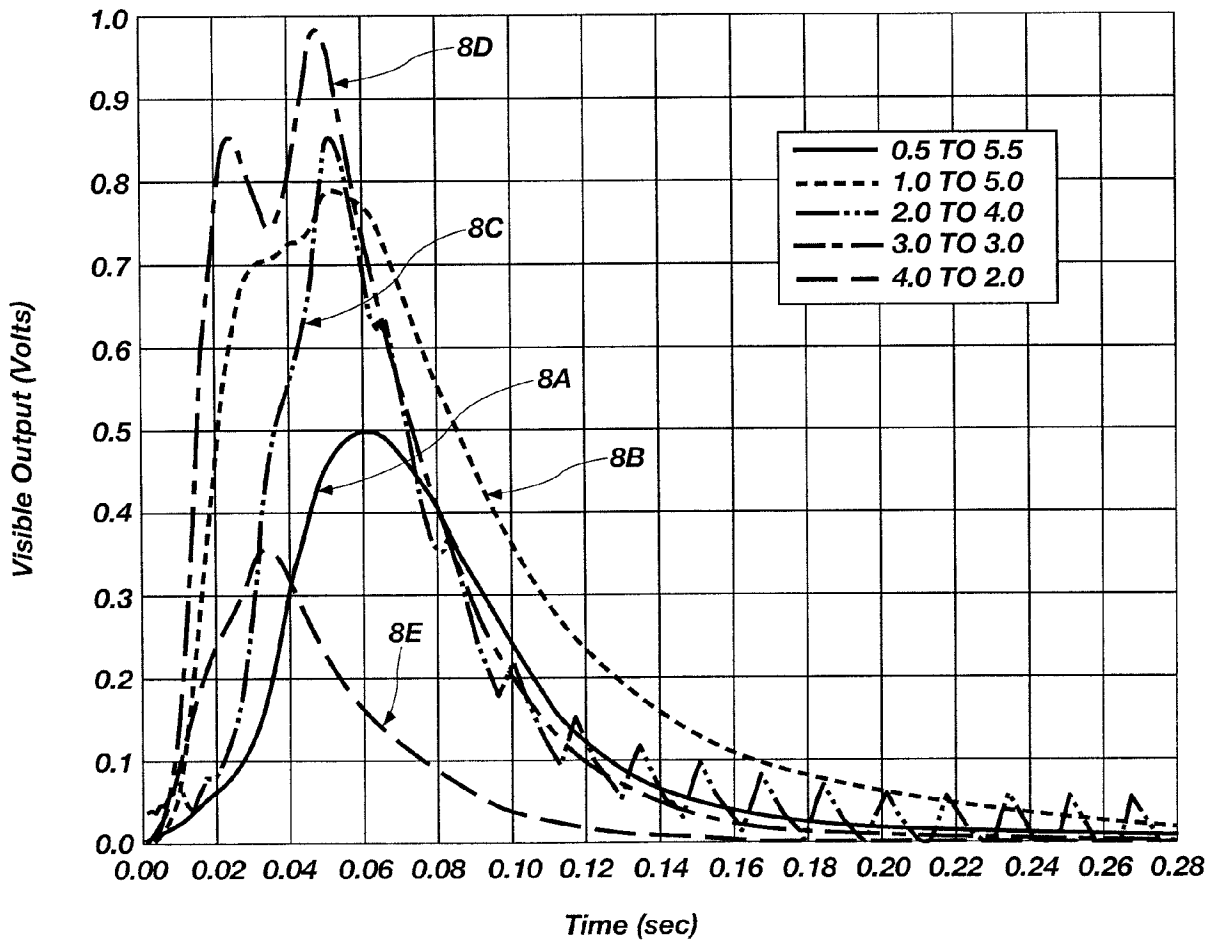
FIG. 8 illustrates a graph displaying visible light output versus time for different ratios of igniter/activator to illuminant according to embodiments of the invention.

For each of the tests illustrated in FIG. 8, a layered non-lethal payload test was performed. An igniter/activator comprising boron potassium nitrate was used with a flaked aluminum illuminant. Five tests were performed, with ratios of igniter/activator to illuminant of 0.5 to 5.5 (8A); 1.0 to 5.0 (8B); 2.0 to 4.0 (8C); 3.0 to 3.0 (8D); and 4.0 to 2.0 (8E), respectively. The visible output data determined over time is illustrated in FIG. 8.

The data of FIG. 8 indicate that relatively small amounts of igniter/activator are required to maximize the light output of a non-lethal payload. In fact, the greatest total light output was obtained when the ratio of igniter/activator to illuminant was 1.0 to 5.0 (8B).

Example 4

Different mixtures of fuels and activators were also created and tested as mixtures for use as non-lethal payloads according to embodiments of the invention. A first mixture, designated I/A-1, comprised an illuminant of flaked aluminum, specifically A1-03-272 4.1 UN 1309 Black Pyro. The igniter/activator of the I/A-1 mixture comprised magnesium strontium nitrate (Mg/SrN), specifically UIX189 in a 20-mesh size, with boron potassium nitrate (B/KN), specifically UIX156 in 24/60 mesh sizes, the combination in a 50/50 weight ratio. The I/A-1 mixture included 33.0 grams of illuminant and 10.00 grams of igniter/activator, resulting in an illuminant to igniter/activator ratio of 3.30.

A second mixture, designated I/A-2, comprised an illuminant of fine, spherical magnesium (Mg), specifically Mill-M-382 Type III Granulation 16 special. The I/A-2 igniter/activator comprised a combination of UIX189 20-mesh and boron potassium nitrate (B/KN), specifically UIX156 in 24/60 mesh sizes, the combination in a 50/50 weight ratio. The I/A-2 mixture included 52.20 grams of illuminant and 7.79 grams of igniter/activator, resulting in an illuminant to igniter/activator ratio of 6.70.

A third mixture, designated I/A-3, comprised an illuminant of fine, spherical magnesium (Mg), specifically Mil-M-382 Type III Granulation 16 special, mixed with sodium nitrate ($NaNO_3$) 12 mic 2159-0087 in a 3:2 weight ratio. The I/A-3 igniter/activator comprised boron potassium nitrate (B/KN), specifically UIX156 in 24/60 mesh sizes.

Figure 4:
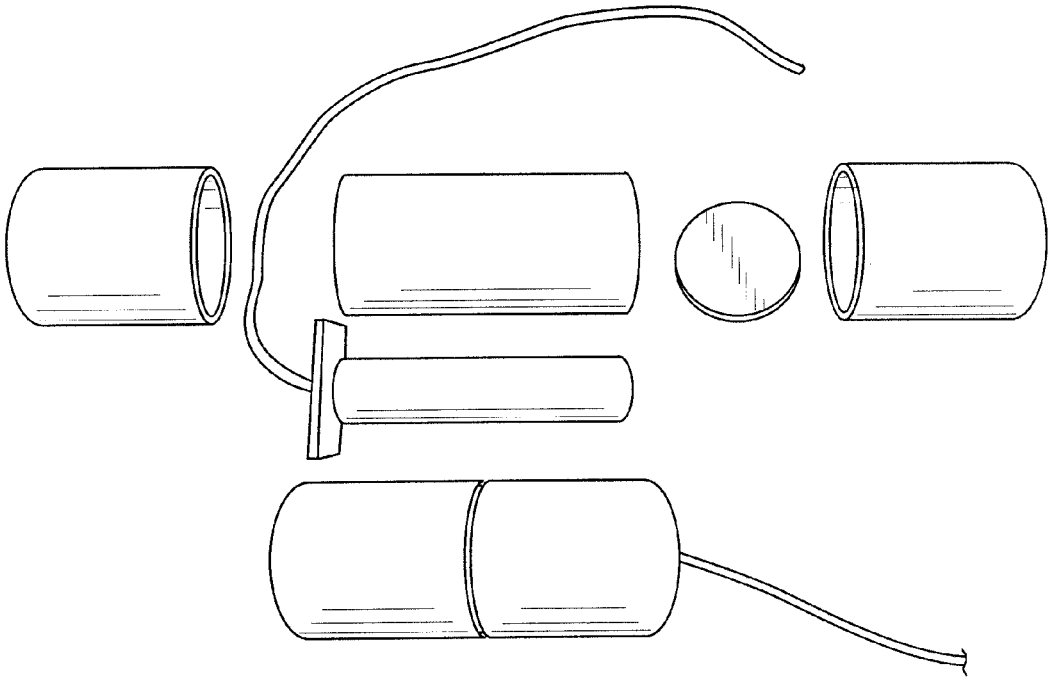
FIG. 4 illustrates a disassembled, modified M116A1 hand-grenade simulator casing and fuse and an assembled, modified M116A1 hand-grenade simulator casing and fuse.

Testing of the I/A-1, I/A-2, and I/A-3 mixtures was performed using modified Mark116A1 grenade simulator bodies, such as the grenade simulator bodies illustrated in FIG. 4. The testing was based upon radial placement of the illuminant and igniter/activator combinations within the grenade simulators. The igniter/activator components of the test mixtures were packed in the interior radial compartment of the grenade simulator and the illuminant components of the test mixtures were packed in an annulus between the interior radial compartment and the outer grenade body. Initiation devices in communication with the igniter/activator in the interior radial compartment were used to activate the simulated grenades. In the tests performed, the initiation devices included electric matches that were inserted through the body of the grenade and centered in the grenade. Data recorded upon the activation of the simulated grenades are illustrated in Table I.

TABLE I

| Illuminant/ Activator Mixture | Illuminant/ Activator Ratio | Light Output (klux * s) | Near Field Pressure (psi) | Fireball Time (s) | Fireball Area (rectangular, $ft^2$) |
|---|---|---|---|---|---|
| I/A-1 | 3.30 | 18.20 | 4.20 | 0.27 | 183.1 |
| I/A-2 | 6.70 | 120.00 | 2.40 | 0.60 | 225.6 |
| I/A-3 | 6.92 | 34.00 | 2.90 | 0.20 | 271.0 |

The light output data of Table I was determined as a function of time using a photopic light detector. The integration of the light intensity or illuminance (klux) monitored versus the time at which various light intensities were recorded yielded a measurement of total light output in units of klux-seconds (klux*s). The near field pressure data was measured using pencil gauges placed at a standoff distance of 18 inches (45 cm). The data were plotted as a function of time and the maximum pressures achieved are listed in Table I. The fireball time and fireball area measurements were taken using high speed and normal speed video traces. The fireball time was computed by monitoring the number of frames of video in which the fireball was present. The field of view in the video traces included a dimensional standard of reference from which the width and height of the fireball were calculated, allowing the rectangular fireball area to be calculated.

Example 5

Non-lethal payloads according to embodiments of the invention were also tested and compared to conventional Mk141 diversionary devices. Light intensity versus time data was measured and plotted in FIG. 9 and other collected data is listed in Table II.

The non-lethal payloads compared to the Mk141 diversionary devices included a non-lethal payload according to embodiments of the invention having an illuminant of activated black pyro aluminum and an igniter/activator of UIX156 and a non-lethal payload comprising an illuminant of activated spherical magnesium and an igniter/activator of UIX156 and UIX189 in a 50/50 weight percent mixture.

Figure 9:
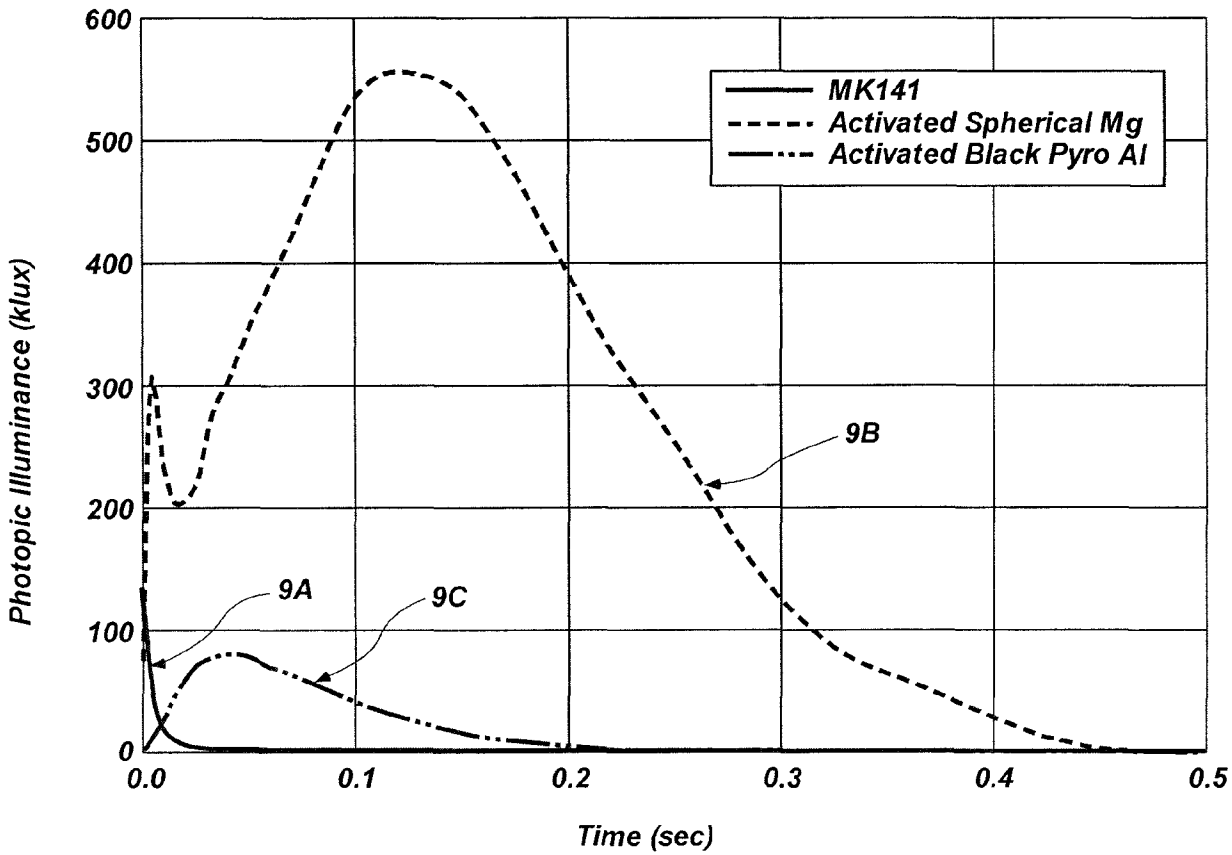
FIG. 9 illustrates a graph displaying photopic illuminance versus time for conventional flash-bang devices and non-lethal payloads according to embodiments of the invention.

As illustrated in FIG. 9, the data indicate that the non-lethal payload comprising the activated spherical magnesium (9B) produced the greatest amount of light. The non-lethal payload comprising the spherical magnesium as an illuminant also produced a considerably lower pressure at eighteen inches than did the Mk141 (9A), as shown by the data in Table II. The non-lethal payload comprising the activated black pyro aluminum (9C) also produced a lower pressure at eighteen inches than did the Mk141. The lower pressures produced by the non-lethal payloads of embodiments of the invention is desirable because the pressures produced by the Mk141 can cause permanent injury to both hearing and as explosive injuries.

TABLE II

| | Mk141 (9A) | Activated Black Pyro Aluminum Non-Lethal Payload (9C) | Activated Spherical Magnesium Non-Lethal Payload (9B) |
|---|---|---|---|
| Flash | 1.6 klux * s | 21 klux * s | 114 klux * s |
| Bang | 19 psi at 18" | 1.3 psi at 18" | 2.8 psi at 18" |
| Illuminant to Igniter/Activator Ratio | Typical Flash Powder (KP/Al) | 6.4:1 | 6.7:1 |

Having thus described certain currently preferred embodiments of the present invention, it is understood that the invention defined by the appended claims is not to be limited by particular details set forth in the above description, as many apparent variations thereof are contemplated without departing from the spirit or scope thereof as hereinafter claimed.

What is claimed is:

1. A non-lethal payload, comprising:

an igniter/activator comprising a mixture of boron potassium nitrate and magnesium strontium nitrate, the boron potassium nitrate comprising a mixture of from 21.7% to 25.7% boron and from 68.7% to 72.7% potassium nitrate, and the magnesium strontium nitrate comprising a mixture of magnesium and strontium nitrate; and a powdered illuminant consisting of magnesium, wherein the igniter/activator and the powdered illuminant are separate compositions in contact with, but separately positioned from, one another in the non-lethal payload and wherein the igniter/activator is configured to directly ignite the powdered illuminant.

2. The non-lethal payload of claim 1, wherein the igniter/activator and the powdered illuminant are present in a ratio of about 1 to 5, respectively.

3. The non-lethal payload of claim 1, wherein the igniter/activator comprises a mixture of boron potassium nitrate and magnesium strontium nitrate in a weight ratio of about 50 percent boron potassium nitrate and about 50 percent magnesium strontium nitrate.

4. A non-lethal payload, comprising:

an igniter/activator comprising boron, potassium nitrate, magnesium, and strontium nitrate; and a powdered illuminant consisting of magnesium and an oxidizer, wherein the igniter/activator and the powdered illuminant are separate compositions in contact with, but separately positioned from, one another in the non-lethal payload and wherein the igniter/activator is configured to directly ignite the powdered illuminant.

5. The non-lethal payload of claim 4, wherein the oxidizer is selected from the group consisting of sodium nitrate and strontium nitrate.

6. The non-lethal payload of claim 4, wherein the oxidizer comprises from about 1 percent by weight to about 40 percent by weight of the powdered illuminant.

7. The non-lethal payload of claim 1, wherein a layer of the igniter/activator overlies a layer of the powdered illuminant.

8. The non-lethal payload of claim 1, wherein the powdered illuminant surrounds the igniter/activator.

9. A non-lethal payload, comprising:

an igniter/activator consisting of a binder and a mixture of boron, potassium nitrate, magnesium, and strontium nitrate; and a powdered illuminant consisting of magnesium, wherein the igniter/activator and the powdered illuminant are separate compositions in contact with, but separately positioned from, one another in the non-lethal payload and wherein the igniter/activator is configured to directly ignite the powdered illuminant.

10. The non-lethal payload of claim 1, wherein the igniter/activator and the powdered illuminant are present in the non-lethal payload in a ratio of between about 1 to 20 and about 5 to 1.

11. The non-lethal payload of claim 1, wherein the igniter/activator further comprises a binder.

12. The non-lethal payload of claim 1, wherein the powdered illuminant consists of powdered magnesium.

13. The non-lethal payload of claim 1, wherein the igniter/activator comprises from about 5% to about 95% boron potassium nitrate and from about 5% to about 95% magnesium strontium nitrate.

14. The non-lethal payload of claim 1, wherein the igniter/activator and the powdered illuminant are present in the non-lethal payload in a powdered illuminant to igniter/activator ratio of 6.70.

* * * * *

UNITED STATES PATENT AND TRADEMARK OFFICE

CERTIFICATE OF CORRECTION

PATENT NO. : 8,172,966 B2
APPLICATION NO. : 11/369908
DATED : May 8, 2012
INVENTOR(S) : Reed J. Blau et al.

It is certified that error appears in the above-identified patent and that said Letters Patent is hereby corrected as shown below:

In the specification:

COLUMN 10, LINE 36, change “near-filed” to --near-field--

Signed and Sealed this
Twenty-second Day of October, 2013

Teresa Stanek Rea
*Deputy Director of the United States Patent and Trademark Office*